US006533071B1

(12) United States Patent
Smith

(10) Patent No.: US 6,533,071 B1
(45) Date of Patent: Mar. 18, 2003

(54) LADDER WITH INCORPORATED STABILIZERS

(76) Inventor: Winston Smith, 28A Henshaw Rd., Inwood, WV (US) 25428

( * ) Notice: Subject to any disclaimer, the term of this patent is extended or adjusted under 35 U.S.C. 154(b) by 0 days.

(21) Appl. No.: 10/037,770

(22) Filed: Dec. 28, 2001

Related U.S. Application Data

(60) Provisional application No. 60/258,638, filed on Dec. 29, 2000.

(51) Int. Cl.[7] ..... E06C 1/00
(52) U.S. Cl. ..... 182/172; 182/165
(58) Field of Search ..... 182/172, 107, 182/170, 165, 168, 171; 248/188.2–188.5

(56) References Cited

U.S. PATENT DOCUMENTS 3,568,798 A * 3/1971 Pierce ..... 182/172
3,856,112 A * 12/1974 Stewart ..... 182/172
4,433,754 A * 2/1984 Beach ..... 182/172
4,683,983 A 8/1987 Murphy
4,899,849 A 2/1990 Levi et al.
4,949,809 A * 8/1990 Levi et al. ..... 182/172
5,267,631 A * 12/1993 Mendel ..... 182/172 X
5,462,133 A 10/1995 Merrill, Jr.
5,511,632 A * 4/1996 Ermis ..... 182/172
6,065,566 A * 5/2000 Brown et al. ..... 182/172

* cited by examiner

*Primary Examiner*—Daniel P. Stodola
*Assistant Examiner*—Hugh B. Thompson
(74) *Attorney, Agent, or Firm*—Matthew J. Peirce

(57) ABSTRACT

A ladder with an incorporated pair of stabilizers. Each stabilizer comprises a base leg and an adjustable leg. Each adjustable leg is pivotally mounted on a side of the ladder, with the adjustable leg having a plurality of holes over its length. The base leg slides on a track within the adjustable leg and can be set to a specific length. An additional locking means is provided to temporarily lock the adjustable leg to the side of the ladder while in use.

2 Claims, 2 Drawing Sheets

18
16
20
14
6
8
22
24

LADDER WITH INCORPORATED STABILIZERS

This application claims the benefit of Provisional Application No. 60/258,638, filed Dec. 29, 2000.

I. BACKGROUND OF THE INVENTION

The present invention concerns that of a new and improved ladder with an incorporated pair of stabilizer for use with the ladder.

II. DESCRIPTION OF THE PRIOR ART

U.S. Pat. No. 5,462,133, issued to Merrill, Jr., et al., discloses a stepladder stabilizer comprising a telescopically adjustable leg having an upper end and a lower end.

U.S. Pat. No. 4,899,849, issued to Levi et al., discloses a stabilizer apparatus for attachment to an extension ladder for inhibiting sideways tipping and downward/rearward slipping thereof.

U.S. Pat. No. 4,683,983, issued to Murphy, discloses a ladder leveling apparatus which includes a frame portion, a support portion, a slider portion, a retainer portion and a positioner portion.

III. SUMMARY OF THE INVENTION

A new and improved ladder is disclosed that includes an incorporated pair of stabilizers. Each stabilizer comprises a base leg and an adjustable leg. Each adjustable leg is pivotally mounted on a side of the ladder, with the adjustable leg having a plurality of holes over its length. The base leg slides on a track within the adjustable leg and can be set to a specific length. An additional locking means is provided to temporarily lock the adjustable leg to the side of the ladder while in use.

There has thus been outlined, rather broadly, the more important features of a ladder with an incorporated pair of stabilizers in order that the detailed description thereof that follows may be better understood and in order that the present contribution to the art may be better appreciated. There are, of course, additional features of the ladder with an incorporated pair of stabilizers that will be described hereinafter and which will form the subject matter of the claims appended hereto.

In this respect, before explaining at least one embodiment of the ladder with an incorporated pair of stabilizers in detail, it is to be understood that the ladder with an incorporated pair of stabilizers is not limited in its application to the details of construction and to the arrangements of the components set forth in the following description or illustrated in the drawings. The ladder with an incorporated pair of stabilizers is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present ladder with an incorporated pair of stabilizers. It is important, therefore, that the claims be regarded as including such equivalent constructions insofar as they do not depart from the spirit and scope of the present invention.

It is therefore an object of the present invention to provide a ladder with an incorporated pair of stabilizers which has all of the advantages of the prior art and none of the disadvantages.

It is another object of the present invention to provide a ladder with an incorporated pair of stabilizers which may be easily and efficiently manufactured and marketed.

It is another object of the present invention to provide a ladder with an incorporated pair of stabilizers which is of durable and reliable construction.

It is yet another object of the present invention to provide a ladder with an incorporated pair of stabilizers which is economically affordable and available for relevant purchasing government entities.

Other objects, features and advantages of the present invention will become more readily apparent from the following detailed description of the preferred embodiment when considered with the attached drawings and appended claims.

IV. BRIEF DESCRIPTION OF THE DRAWINGS

V. DESCRIPTION OF THE PREFERRED EMBODIMENT

Figure 1:
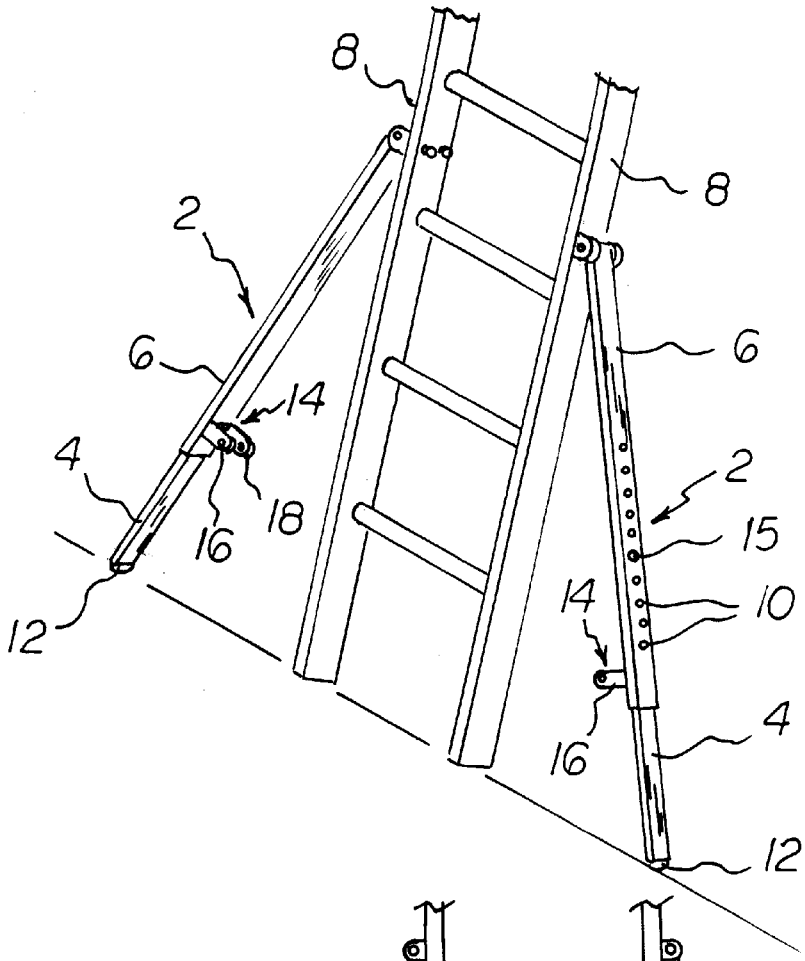
FIG. 1 shows a perspective view of the present invention as it would appear in use as a stabilizer.
Figure 2:
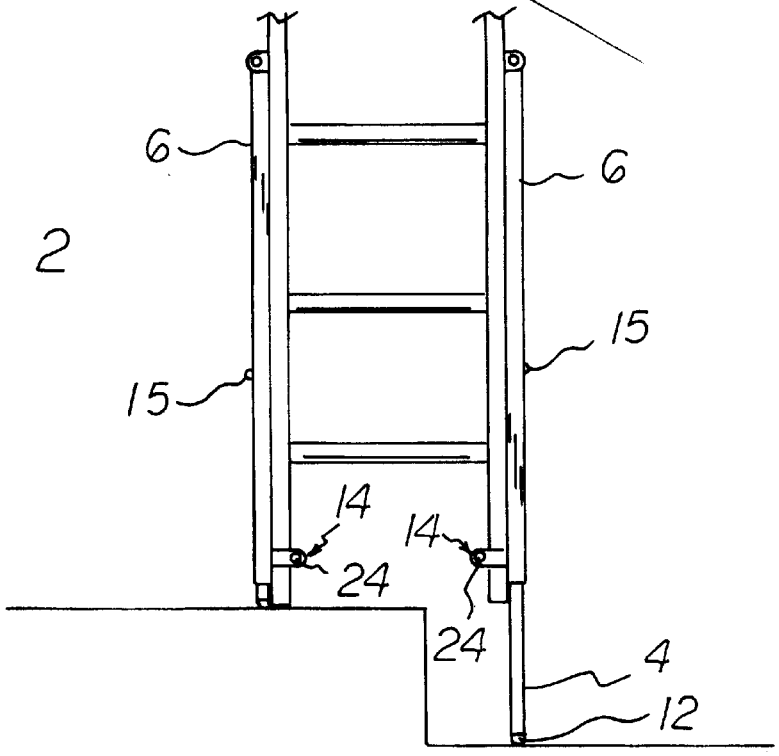
FIG. 2 shows a perspective view of the present invention as it would appear in use as a leveler.

FIGS. 1 and 2 show perspective views of the stabilizer 2 as it would appear in use as a stabilizer and leveler, respectively. Although stabilizer 2 has more than one use, the mechanics and attachment mechanism of the present invention to a ladder remain the same.

Each stabilizer 2 comprises a adjustable leg 4 and an attachable side leg 6. The attachable side leg 6 is pivotally mounted on the side of a ladder 8, with the attachable side leg 6 having a plurality of holes 10 over its length. The adjustable leg 4 slides on track within the attachable side leg 6 and can be set to a specific length.

Attachable side leg 6 has two ends, a first end and a second end, with the first end of attachable side leg 6 being pivotally mounted to the side of ladder 8 approximately halfway between the length of the top and bottom of ladder 8. Attachable side leg 6 is designed to pivot outwards. Attachable side leg 6 has approximately a rectangular cross-section shape, having an outer flat surface that has a plurality of holes 10 evenly spaced out along its length.

Adjustable leg 4 has two ends, a first end and a second end. Adjustable leg 4 slides on track within the attachable side leg 6 and can be set to a specific length. The second end of adjustable leg 4 has a rubber pad 12 to ensure that stabilizer 2 will not slip or move once properly set.

Adjustable leg 4 also has at least one ball clip 15 attached to the surface of adjustable leg 4 that is in contact with the surface of attachable side leg 6 that includes the plurality of holes 10. Ball clip 15 would be pushable in an inward direction, but internal mechanisms would always push against ball clip 15 in an outer direction. Ball clip 15 would have the same approximate diameter of the holes in the plurality of holes 10, allowing adjustable leg 4 to be "locked" into a specific length while in the track on attachable side leg 6. To "unlock" adjustable leg 4 from attachable side leg 6, a user need only to push in all ball clips 15 and readjust adjustable leg 4.

The second end of attachable side leg 6 has bracket 14, with bracket 14 having arms 16 and 18. Once adjustable leg 4 has been set to a proper length, bracket 14 is used to lock in the stabilizer 2 to a specific length in order to ensure that ladder 8 can properly bear weight. Arms 16 and 18 of bracket 14 are designed to extend on each side of a rung of ladder 8, at which time, a user-can tighten bracket 14 with the use of bolt 20, washer 22, and nut 24. Arms 16 and 18 would then provide a tightening force around the leg of the ladder.

Figure 3:
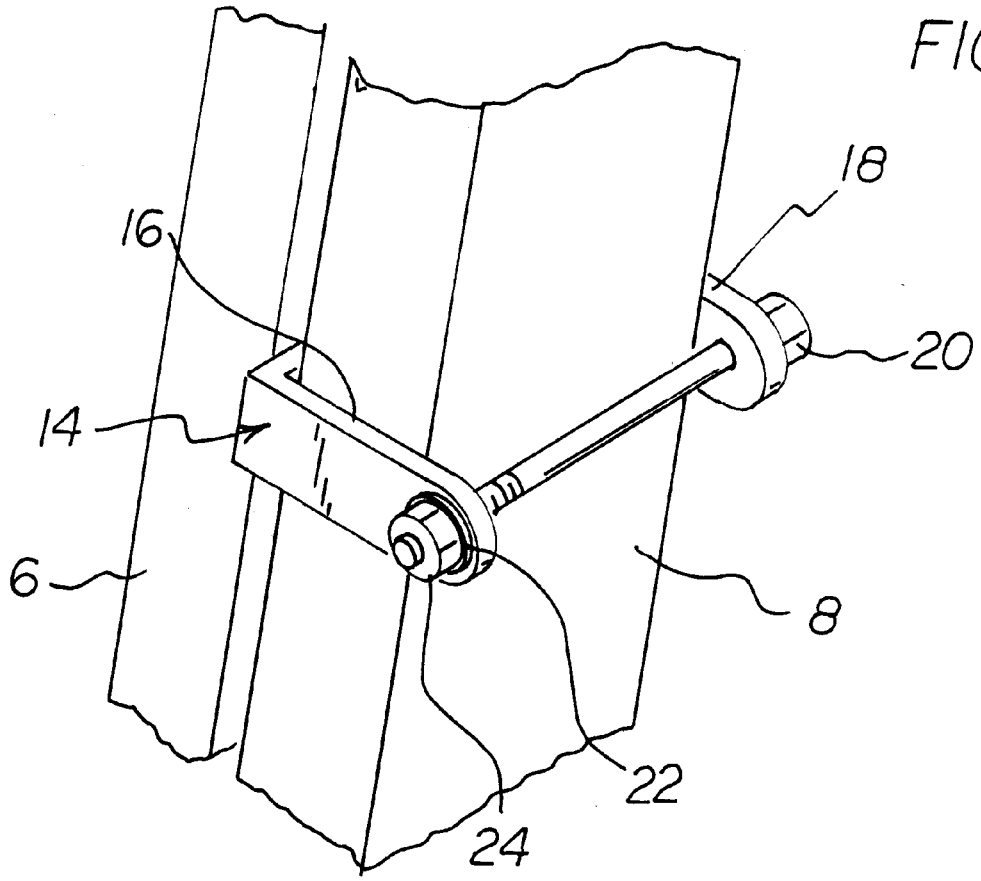
FIG. 3 shows a perspective view of the bracket used with the present invention after the bracket has been locked in place.

FIG. 3 shows a perspective view of bracket 14 after bracket 14 has been locked in place with bolt 20, washer 22, and nut 24.

What I claim as my invention is:

1. A ladder comprising:

(a) a pair of side frames, a first side frame and a second side frame, each side frame having two surfaces, an inner surface and an outer surface, (b) a plurality of rungs, each of the rungs having two ends, a first end and a second end, the first end of each rung attached to the inner surface of the first side frame, the second end of each rung attached to the inner surface of the second side frame, the rungs being evenly spaced out and parallel to one another, (c) a pair of attachable side legs, a first attachable side leg and a second attachable side leg, each attachable side leg having two ends, a first end and a second end, the first end of the first attachable side leg being pivotally attached to the outer surface of the first side frame, the first end of the second attachable side leg being pivotally attached to the outer surface of the second side frame, each attachable side leg being hollow and having a rectangular cross-sectional shape, each attachable side leg having an outward-facing flat surface, each attachable side leg having a plurality of holes evenly spaced out in linear fashion on the outward-facing flat surface, (d) a pair of adjustable legs, a first adjustable leg and a second adjustable leg, the first adjustable leg track-mounted within the first attachable side leg, the second adjustable leg track-mounted within the second attachable side leg, the first adjustable leg including a first base clip, the first base clip being inwardly pushable, the first adjustable leg including an internal tension pushing outward against the first base clip, the second adjustable leg including a second base clip, the second base clip being inwardly pushable, the second adjustable leg including an internal tension pushing outward against the second base clip, whereby a user would be able to slide each adjustable leg around within the attachable side leg by pushing in the respective base clip and sliding the adjustable leg up or down the appropriate track, (e) locking means for securing the first adjustable side leg to a specific length, the locking means further comprising (i) a first bracket attached to the second end of the first attachable side leg, the first bracket comprising a base having two ends, a first end and a second end, the first bracket also including a pair of arms, a first arm and a second arm, each arm having two ends, a first end and a second end, the first end of the first arm attached to the first end of the base at a ninety degree angle, the first end of the second arm attached to the second end of the base at a ninety degree angle, each of the arms placed to surround the first side frame of the ladder when the first attachable side leg is placed flush against the first side frame of the ladder, the arms extending between an inch to three inches beyond the first side frame of the ladder, (ii) a pair of holes, a first hole and a second hole, the first hole being located near the second end of the first arm, the second hole being located near the second arm of the second arm, (iii) a screw inserted through both the first hole and the second hole, (iv) a nut threadably attached to one end of the screw, (v) whereby a user would tighten the nut, causing the screw to pull together the first arm and the second arm of the first bracket, thereby causing the first arm and the second arm of the first bracket to contract against the first side frame of the ladder, whereby the first attachable side leg would be locked against the second side frame of the ladder, and (f) locking means for securing the second adjustable side leg to a specific length.

2. The ladder according to claim 1 wherein the locking means for securing the second adjustable side leg to a specific length further comprises:

(a) a second bracket attached to the second end of the second attachable side leg, the second bracket comprising a base having two ends, a first end and a second end, the second bracket also including a pair of arms, a first arm and a second arm, each arm having two ends, a first end and a second end, the first end of the first arm attached to the first end of the base at a ninety degree angle, the first end of the second arm attached to the second end of the base at a ninety degree angle, each of the arms placed to surround the second side frame of the ladder when the second attachable side leg is placed flush against the second side frame of the ladder, the arms extending between an inch to three inches beyond the second side frame of the ladder, (b) a pair of holes, a first hole and a second hole, the first hole being located near the second end of the first arm, the second hole being located near the second arm of the second arm, (c) a screw inserted through both the first hole and the second hole, (d) a nut threadably attached to one end of the screw, (e) whereby a user would tighten the nut, causing the screw to pull together the first arm and the second arm of the second bracket, thereby causing the first arm and the second arm of the second bracket to contract against the second side frame of the ladder, whereby the second attachable side leg would be locked against the second side frame of the ladder.

* * * * *